US011542128B2

(12) United States Patent
Svintozelsky et al.

(10) Patent No.: US 11,542,128 B2
(45) Date of Patent: Jan. 3, 2023

(54) SUBJECT LIFT TRANSFER ASSEMBLIES AND METHODS FOR OPERATING THE SAME

(71) Applicant: Liko Research & Development AB, Luleå (SE)

(72) Inventors: Samuel Svintozelsky, Batesville, IN (US); Sravan Mamidi, Batesville, IN (US); Joseph Tari, Batesville, IN (US); Renee Tozer, Batesville, IN (US); Abidemi Ajayi, Batesville, IN (US); Tyler Nigolian, Batesville, IN (US)

(73) Assignee: LIKO RESEARCH & DEVELOPMENT AB, Lulea (SE)

( * ) Notice: Subject to any disclaimer, the term of this patent is extended or adjusted under 35 U.S.C. 154(b) by 533 days.

(21) Appl. No.: 16/702,726

(22) Filed: Dec. 4, 2019

(65) Prior Publication Data

US 2020/0180919 A1 Jun. 11, 2020

Related U.S. Application Data

(60) Provisional application No. 62/777,933, filed on Dec. 11, 2018.

(51) Int. Cl.
*B66C 19/00* (2006.01)
*B66C 13/22* (2006.01)
*A61G 7/10* (2006.01)

(52) U.S. Cl.
CPC ..... *B66C 19/00* (2013.01); *A61G 7/1015* (2013.01); *A61G 7/1042* (2013.01); *B66C 13/22* (2013.01); *A61G 2203/40* (2013.01)

(58) Field of Classification Search
CPC ..... B66C 19/00; B66C 13/22; A61G 7/1015; A61G 7/1042; A61G 2203/40; B66F 11/04; B66F 13/00; B66D 3/26
See application file for complete search history.

(56) References Cited

U.S. PATENT DOCUMENTS 5,511,256 A * 4/1996 Capaldi ..... A61G 7/1051 403/217
7,237,491 B2 * 7/2007 Faucher ..... A61G 7/1042 5/85.1

(Continued)

FOREIGN PATENT DOCUMENTS

CA 3001069 A1 4/2017
EP 3335685 A1 6/2018

(Continued)

OTHER PUBLICATIONS

Chinese Patent Office; Office Action for Chinese Patent Application No. 201911246055; dated Dec. 1, 2020, 8 pgs.

(Continued)

*Primary Examiner* — David R Hare
*Assistant Examiner* — Rahib T Zaman
(74) *Attorney, Agent, or Firm* — Dinsmore & Shohl LLP

(57) ABSTRACT

A lift system includes a trolley member defining an aperture extending through the trolley member, a locking unit coupled to the trolley member, the locking unit including a locking unit body and a pin that extends outward from the locking unit body, where the pin is repositionable between an engaged position, in which the pin extends through and outward from the aperture of the trolley member, and a disengaged position, a cable extending between and terminating at an actuator end that is engaged with the actuator and a subject lift end positioned opposite the actuator end, where the cable is selectively drawn to the trolley member or paid out from the trolley member upon actuation of the actuator, and a subject lift connecting member coupled the subject lift end of the cable.

20 Claims, 12 Drawing Sheets

(56) References Cited

U.S. PATENT DOCUMENTS

| | | | | |
|---|---|---|---|---|
| 7,240,621 | B2 * | 7/2007 | Chepurny | A61G 7/1042 104/173.1 |
| 7,350,247 | B2 * | 4/2008 | Bogh-Sorensen | A61G 7/1042 5/85.1 |
| 8,701,226 | B2 * | 4/2014 | Faucher | A61G 7/1042 5/85.1 |
| 9,421,140 | B2 * | 8/2016 | Faucher | A61G 7/1015 |
| 9,796,168 | B2 * | 10/2017 | Bergenstråle | B32B 37/02 |
| 9,925,107 | B2 | 3/2018 | Faucher et al. | |
| 2010/0051889 | A1 * | 3/2010 | Chepurny | A61G 7/1051 254/339 |
| 2012/0325586 | A1 * | 12/2012 | Meggs | B64D 11/0697 182/231 |
| 2014/0131301 | A1 * | 5/2014 | Newkirk | A61G 7/1025 248/661 |
| 2015/0122761 | A1 * | 5/2015 | Ford | B66C 13/16 212/276 |
| 2015/0368074 | A1 * | 12/2015 | Sturm | B66C 17/00 212/312 |
| 2020/0085659 | A1 * | 3/2020 | Tari | B66C 15/00 |
| 2020/0183362 | A1 * | 6/2020 | Ledwith | A61G 7/1061 |
| 2021/0369527 | A1 * | 12/2021 | Dole | A61G 7/1076 |

FOREIGN PATENT DOCUMENTS

| | | | |
|---|---|---|---|
| JP | H09579 | A | 1/1997 |
| WO | 2003064312 | A2 | 8/2003 |
| WO | 2017059526 | A1 | 4/2017 |

OTHER PUBLICATIONS

Extended European Search Report dated Apr. 22, 2020 relating to European Application No. 19214997.9-1113.

* cited by examiner

SUBJECT LIFT TRANSFER ASSEMBLIES AND METHODS FOR OPERATING THE SAME

CROSS-REFERENCE TO RELATED APPLICATIONS

This application claims the benefit of U.S. Provisional Patent Application Ser. No. 62/777,933 filed Dec. 11, 2018 and entitled "Subject Lift Transfer Assemblies and Methods for Operating the Same," the contents of which are hereby incorporated by reference in their entirety.

FIELD

The present specification generally relates to subject lift transfer assemblies for subject lifting systems, and methods for operating the same.

TECHNICAL BACKGROUND

Subject lifts, such as overhead lifts, are used to transport subjects for any number of reasons. Overhead lifts may be mounted to a ceiling and may include a motor and a lift drum that is driven by the motor. A lift strap may be coupled to the lift drum for lifting and lowering a subject when the drum is rotated. For example, as the lift drum rotates, the lift strap is either wound up onto the lift drum or paid out from the lift drum. A sling bar may be attached to the overhead lift to connect a subject to the overhead lift. For example, an accessory such as a sling, a vest, or the like, may be attached to a subject, and the accessory may be coupled to the sling bar to connect the subject to the overhead lift, such that the subject may be lifted or lowered as the lift strap is wound up onto the lift drum or paid out from the lift drum.

Overhead lifts may generally be engaged with ceiling-mounted rails, and the overhead lifts may be movable along the rails so that subjects connected to the overhead lifts may be moved between different locations. In many buildings, ceiling-mounted rails are not interconnected, such that the building includes multiple separate rails, each extending through different portions of the building. In operation, it may be necessary to move an overhead lift between different ceiling-mounted rails, which may require a user to remove an overhead lift from one rail, and re-install the overhead lift to another rail. Additionally, in some instances, overhead lifts may need to be removed from the ceiling-mounted rails from time to time, for example to perform maintenance on the overhead lifts. The motor and lift drum of overhead lifts may be heavy, and the removal and re-installation of overhead lifts to a rail may be difficult and require multiple users.

Accordingly, a need exists for alternative subject lift transfer unit assemblies to assist a user in installing an overhead lift to, and removing an overhead lift from a rail.

SUMMARY

In a first aspect, a lift system includes a trolley member defining an aperture extending through the trolley member, a locking unit coupled to the trolley member, the locking unit including a locking unit body and a pin that extends outward from the locking unit body, where the pin is repositionable between an engaged position, in which the pin extends through the aperture of the trolley member, and a disengaged position, in which the pin is retracted toward to the locking unit body such that the pin extends further outward from the locking unit body in the engaged position than in the disengaged position, an actuator coupled to the trolley member, a cable extending between and terminating at an actuator end that is engaged with the actuator and a subject lift end positioned opposite the actuator end, where the cable is selectively drawn to the trolley member or paid out from the trolley member upon actuation of the actuator, and a subject lift connecting member coupled the subject lift end of the cable.

In a second aspect, the disclosure provides a lift system according to the first aspect, further comprising an alignment member positioned on the subject lift connecting member, and an alignment fixture coupled to the trolley member and defining a rotationally-discrete alignment feature, where the rotationally-discrete alignment feature restricts rotation of the subject lift connecting member when the alignment member is engaged with the rotationally-discrete alignment feature.

In a third aspect, the disclosure provides a lift system according to any of the preceding aspects, further comprising a subject lift selectively coupled to the trolley member, the subject lift comprising a housing, a subject lift actuator positioned within the housing, where the subject lift actuator lifts a subject selectively coupled to the subject lift, a cable coupling member positioned on the housing and selectively coupled to the subject lift connecting member, and a trolley coupling member positioned on the housing, the trolley coupling member defining an aperture extending through the trolley coupling member.

In a fourth aspect, the disclosure provides a lift system according to the third aspect, where the pin of the locking unit extends through the aperture of the trolley coupling member and the aperture of the trolley member in the engaged position, and the pin of the locking unit is spaced apart from the aperture of the trolley coupling member in the disengaged position.

In a fifth aspect, the disclosure provides a lift system according to the third or the fourth aspect, further comprising a height sensor coupled to the trolley member, where the height sensor detects a position of the subject lift with respect to the height sensor and where the height sensor is communicatively coupled to the locking unit.

In a sixth aspect, the disclosure provides a lift system according to any of the preceding aspects, further comprising an engagement sensor coupled to the trolley member, where the engagement sensor detects a position of the pin with respect to the aperture of the trolley member.

In a seventh aspect, the disclosure provides a lift system according to any of the preceding aspects, further comprising a transfer assembly electrical interface coupled to the trolley member, where the transfer assembly electrical interface is electrically coupled to the actuator.

In an eighth aspect, the disclosure provides a lift system according to the seventh aspect, where the actuator is powered via current passing from the transfer assembly electrical interface to the actuator.

In a ninth aspect, a lift system includes a subject lift transfer assembly including a trolley member defining an aperture extending through the trolley member, an actuator coupled to the trolley member, a cable extending between and terminating at an actuator end that is engaged with the actuator and a subject lift end positioned opposite the actuator end, where the cable is selectively drawn to the trolley member or paid out from the trolley member upon actuation of the actuator, and a subject lift connecting member coupled the subject lift end of the cable, a subject lift selectively coupled to the trolley member, the subject lift including a housing, a subject lift actuator positioned within the housing, where the subject lift actuator lifts a subject selectively coupled to subject lift, a cable coupling member positioned on the housing and selectively coupled to the subject lift connecting member, and a trolley coupling member positioned on the housing, the trolley coupling member defining an aperture extending through the trolley coupling member, and a locking unit coupled to the trolley member or the subject lift, the locking unit including a locking unit body and a pin that extends outward from the locking unit body, where the pin is repositionable between an engaged position, in which the pin extends through from the aperture of the trolley member and the aperture of the trolley coupling member, and a disengaged position, in which the pin is spaced apart from the aperture of the trolley coupling member.

In a tenth aspect, the disclosure provides a lift system according to the ninth aspect, further comprising an alignment member positioned on the subject lift connecting member, and an alignment fixture coupled to the trolley member and defining a rotationally-discrete alignment feature, where the rotationally-discrete alignment feature restricts rotation of the subject lift connecting member when the alignment member is engaged with the rotationally-discrete alignment feature.

In an eleventh aspect, the disclosure provides a lift system according to the ninth or tenth aspect, further comprising a height sensor coupled to the trolley member, where the height sensor detects a position of the subject lift with respect to the height sensor and where the height sensor is communicatively coupled to the locking unit.

In a twelfth aspect, the disclosure provides a lift system according to any of the ninth, tenth, or eleventh aspects, further comprising an engagement sensor coupled to the trolley member, where the engagement sensor detects a position of the pin with respect to the aperture.

In a thirteenth aspect, the disclosure provides a lift system according to any of the ninth, tenth, eleventh, or twelfth aspects, further comprising a transfer assembly electrical interface coupled to the trolley member, wherein the transfer assembly electrical interface is electrically coupled to the actuator.

In a fourteenth aspect, the disclosure provides a lift system according to the thirteenth aspect, where the actuator is powered via current passing from the transfer assembly electrical interface to the actuator.

In a fifteenth aspect, a method for coupling a subject lift to a rail includes coupling a subject lift connecting member to a subject lift, lifting the subject lift toward a subject lift transfer assembly by drawing a cable coupled to the subject lift connecting member upward with an actuator of the subject lift transfer assembly, aligning an aperture of a trolley coupling member of the subject lift with an aperture of a trolley member of the subject lift transfer assembly, and moving a pin through the aperture of the trolley member and the aperture of the trolley coupling member to couple the subject lift connecting member to the subject lift transfer assembly.

In a sixteenth aspect, the disclosure provides a method according to the fifteenth aspect, further comprising aligning the trolley coupling member of the subject lift with the subject lift transfer assembly by engaging an alignment member positioned on the subject lift connecting member with a rotationally-discrete alignment feature coupled to the trolley member, where the rotationally-discrete alignment feature restricts rotation of the subject lift connecting member.

In a seventeenth aspect, the disclosure provides a method according to the fifteenth aspect or the sixteenth aspect, further comprising detecting that the pin is inserted through the aperture of the trolley member and the aperture of the trolley coupling member.

In an eighteenth aspect, the disclosure provides a method according to the seventeenth aspect, further comprising restricting movement of the subject lift transfer assembly within the rail in response to detecting that the pin is not inserted through the aperture of the trolley member and the aperture of the trolley coupling member.

In a nineteenth aspect, the disclosure provides a method according to any of the fifteenth, sixteenth, seventeenth, or eighteenth aspects, further comprising detecting a distance between the housing of the subject lift and the trolley member, and where moving the pin through the aperture of the trolley member is in response to detecting that the distance between the housing of the subject lift and the trolley member is within a predetermined distance.

In a twentieth aspect, the disclosure provides a method according to any of the fifteenth, sixteenth, seventeenth, eighteenth aspects, or nineteenth aspects, further comprising electrically coupling the actuator to a rail power source coupled to the rail.

Additional features of the subject lift transfer assemblies and methods for operating the subject lift transfer assemblies described herein will be set forth in the detailed description which follows, and in part will be readily apparent to those skilled in the art from that description or recognized by practicing the embodiments described herein, including the detailed description, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
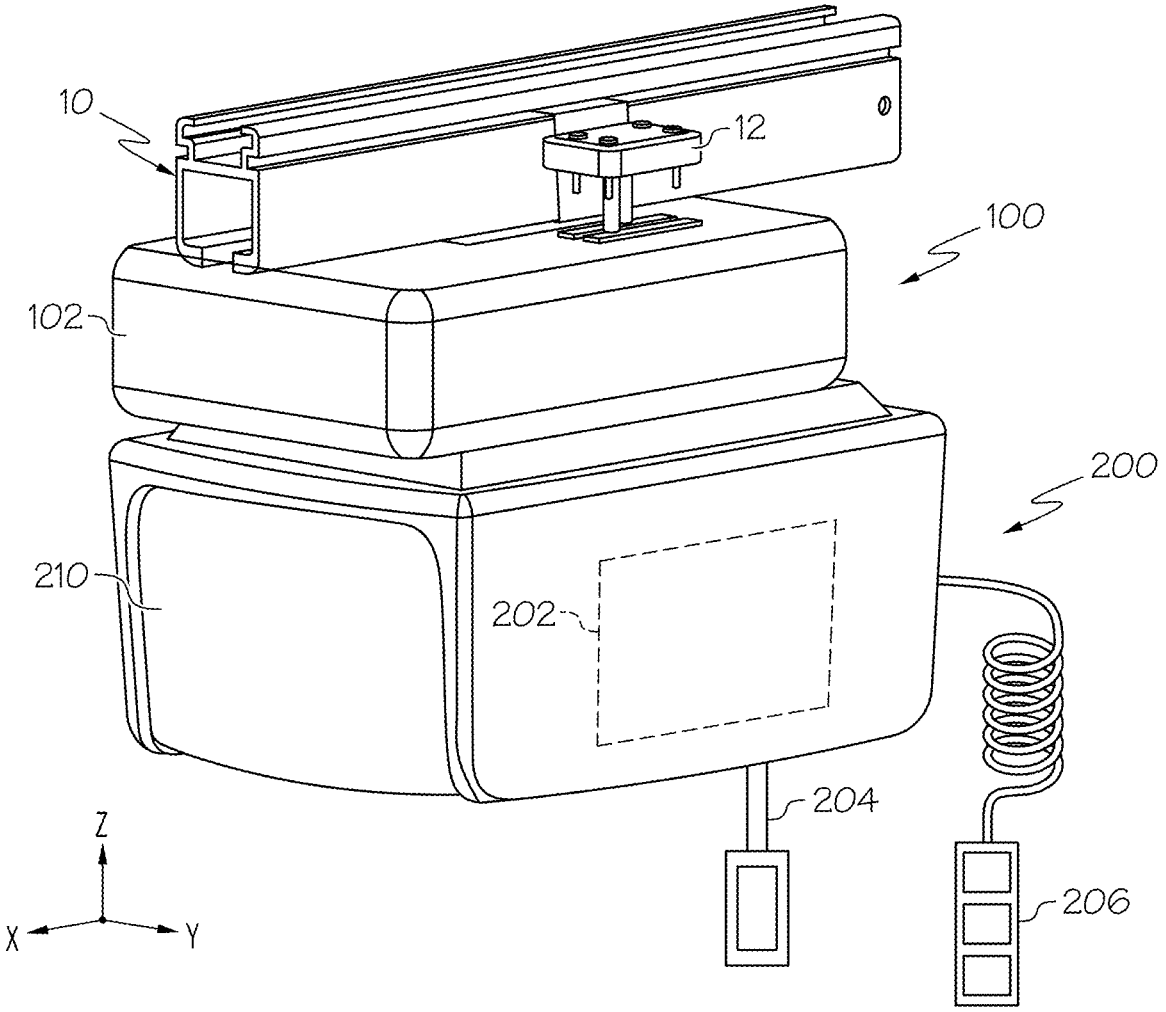
FIG. 1 schematically depicts a front perspective view of a subject lift transfer assembly coupled to a subject lift, according to one or more embodiments shown and described herein.

Reference will now be made in detail to embodiments of subject lift transfer assemblies and methods of operating the same, examples of which are illustrated in the accompanying drawings. Whenever possible, the same reference numerals will be used throughout the drawings to refer to the same or like parts.

Embodiments described herein are directed to subject lift transfer assemblies that selectively couple a subject lift to a rail. Subject lifts may be used to move subjects between various locations, however, subject lifts may be heavy and difficult to install to overhead rails. Subject lift transfer assemblies according to the present disclosure generally include a trolley member and at least one roller rotatably coupled to the trolley member. The at least one roller is enageable with an overhead rail to movably couple the subject lift transfer assembly to the rail. The subject lift transfer assembly may include an actuator and a cable coupled to the actuator, and a subject lift connecting member coupled to the cable. The subject lift connecting member may be selectively coupled to a subject lift, such that the actuator may lift the subject lift towards the subject lift transfer assembly with the cable. The actuator and the cable may draw the subject lift toward the trolley member so that apertures of the trolley member are aligned with apertures of the subject lift. In embodiments, a pin is passed through the apertures of the trolley member and the subject lift to selectively couple the subject lift to the subject lift transfer assembly. With the subject lift coupled to the subject lift transfer assembly, the subject lift, coupled to the rail through the subject lift transfer assembly, may be used to transport a subject between locations via the rail. To remove the subject lift from the subject lift transfer assembly, the pin may be removed from the apertures of the subject lift and the trolley member, and the subject lift may be lowered from the trolley member by the actuator. Various embodiments of subject lift transfer assemblies and methods for operating the same will be described herein with specific reference to the appended drawings.

As used herein, the term "longitudinal direction" refers to the forward-rearward direction of the subject lift transfer assembly (i.e., in the +/−X-direction as depicted). The term "lateral direction" refers to the cross-direction of the subject lift transfer assembly (i.e., in the +/−Y-direction as depicted), and is transverse to the longitudinal direction. The term "vertical direction" refers to the upward-downward direction of the subject lift transfer assembly (i.e., in the +/−Z-direction as depicted), and is transverse to the lateral and the longitudinal directions.

Referring initially to FIG. 1, a perspective view of a subject lift transfer assembly 100 is schematically depicted. The subject lift transfer assembly 100 is engaged with a rail 10 and is selectively coupled to a subject lift 200. The rail 10 may be mounted to a ceiling of a building or the like, such that the subject lift transfer assembly 100 and the subject lift 200 are positioned overhead in the vertical direction. In embodiments, the rail 10 includes a rail power source 12 coupled to the rail 10. The rail power source 12 may provide electrical power to the subject lift transfer assembly 100 and/or the subject lift 200, as described in greater detail herein. The subject lift transfer assembly 100 selectively couples the subject lift 200 to the rail 10, and generally includes a housing 102 surrounding the subject lift transfer assembly 100.

In embodiments, the subject lift 200 generally includes a housing 210, a subject lift actuator 202 positioned within the housing 210, and a strap 204 coupled to the subject lift actuator 202. The strap 204 may be selectively coupled to a subject, for example through a sling bar and an accessory coupled to the sling bar, and the subject lift actuator 202 may draw the strap 204 upward toward subject lift actuator 202, or pay out the strap 204 from the subject lift actuator 202 to move a subject upward or downward in the vertical direction. In embodiments, the subject lift actuator 202 is communicatively coupled to a subject lift controller 206, and actuation of the subject lift actuator 202 may be controlled via input received by the subject lift controller 206. In some embodiments, the subject lift controller 206 may include a controller that is wired to the subject lift actuator 202. In other embodiments, the subject lift controller 206 may include any suitable device for receiving a user input, such as a graphical user interface (GUI), a push-button controller, a computing terminal, or the like, and may be communicatively coupled to the subject lift actuator 202 by any suitable wired or wireless connection.

Figure 2:
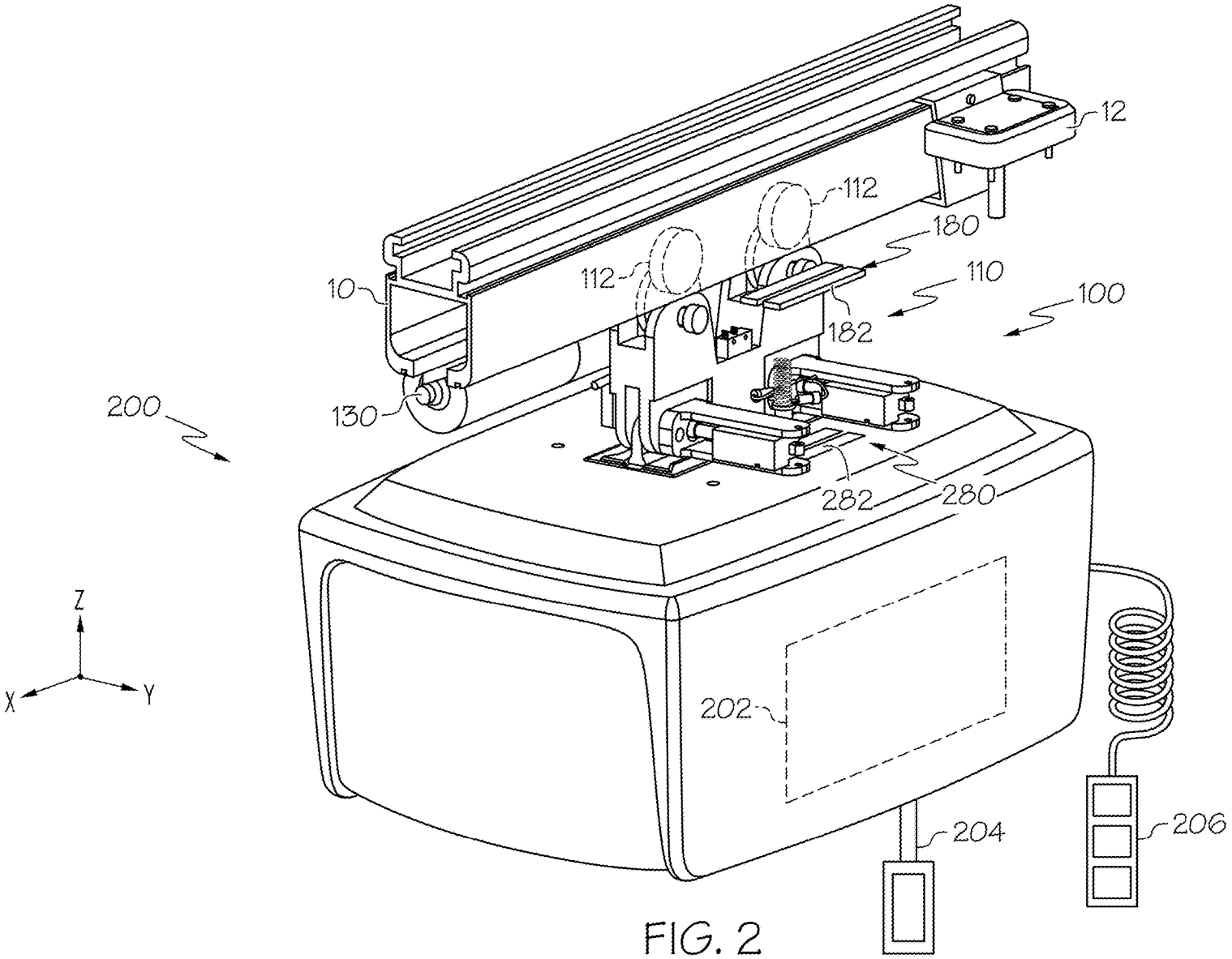
FIG. 2 schematically depicts a front perspective view of the subject lift transfer assembly of FIG. 1 with a housing removed, according to one or more embodiments shown and described herein.

Referring to FIG. 2, a front perspective view of the subject lift transfer assembly 100 is depicted. In embodiments, the subject lift transfer assembly 100 includes a transfer assembly electrical interface 180 coupled to the trolley member 110 and that may be engaged with and electrically coupled to the rail power source 12. More particularly, when the subject lift transfer assembly 100 is positioned below the rail power source 12, a pad 182 of the transfer assembly electrical interface 180 may engage the rail power source 12. Electrical current may be passed between the rail power source 12 and the pad 182 to provide power to a power source of the subject lift transfer assembly 100 (e.g., a battery or the like).

In embodiments, the subject lift 200 includes a subject lift electrical interface 280 that may be engaged with and electrically coupled to the subject lift transfer assembly 100. More particularly, when the subject lift 200 is positioned below the subject lift transfer assembly 100, a pad 282 of the subject lift electrical interface 280 may engage the subject lift transfer assembly 100. Electrical current may be passed between the subject lift transfer assembly 100 and a power source of the subject lift 200 (e.g., a battery or the like) through the subject lift transfer assembly 100. Through the transfer assembly electrical interface 180 and the subject lift electrical interface 280, the rail power source 12 may provide electrical energy to charge power sources of the subject lift transfer assembly 100 and the subject lift 200 when the subject lift transfer assembly 100 and the subject lift 200 are engaged with the rail power source 12.

Figure 3:
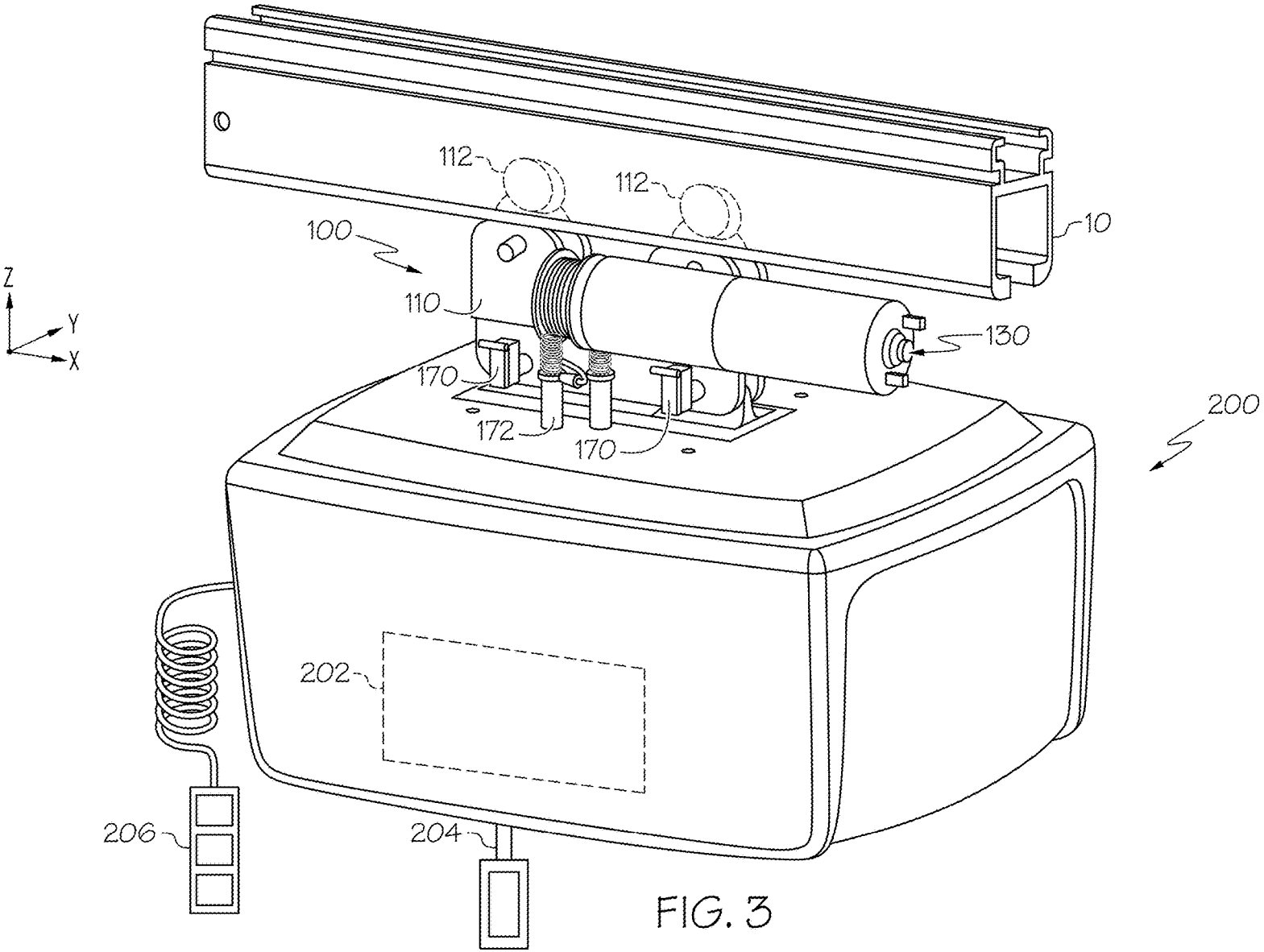
FIG. 3 schematically depicts a rear perspective view of the subject lift transfer assembly of FIG. 1 with the housing removed, according to one or more embodiments shown and described herein.

Referring to FIGS. 2 and 3, the front view and a rear perspective view of the subject lift transfer assembly 100 are depicted, respectively, showing the subject lift transfer assembly 100 with the housing 102 (FIG. 1) removed. The subject lift transfer assembly 100 generally includes a trolley member 110 and at least one roller 112 rotatably coupled to the trolley member 110. The at least one roller 112 is positioned at least partially within the rail 10, thereby coupling the subject lift transfer assembly 100 to the rail 10. With the at least one roller 112 positioned within the rail 10, the subject transfer assembly 100 is movable along the rail 10 in the X-direction as depicted. Through the at least one roller 112 of the subject lift transfer assembly 100, the subject lift 200 is also movable along the rail 10 in the X-direction when the subject lift 200 is coupled to the subject lift transfer assembly 100. In this way, a subject coupled to the subject lift 200 may be moved between different locations along the rail 10. In embodiments, the at least one roller 112 may include any suitable structure rotatably coupled to the trolley member 110 that allows the subject lift transfer assembly 100 to move along the rail 10, and may define a cylindrical or spherical shape positioned within and engaged with the rail 10. In the embodiment depicted in FIGS. 2 and 3, the subject lift transfer assembly 100 includes two rollers 112, however, it should be understood that the subject lift transfer assembly 100 may include any suitable number of rollers 112 coupled to the trolley member 110 and positioned within the rail 10.

In embodiments, the subject lift transfer assembly 100 includes an actuator 130 that operates to selectively lift and lower the subject lift 200 with respect to the subject lift transfer assembly 100. The actuator 130 is operatively coupled to a cable that is selectively coupled to the subject lift 200, as described in greater detail herein. In embodiments, the actuator 130 may be powered in any suitable manner, for example and without limitation, electrical power, hydraulic power, pneumatic power, or the like. In some embodiments, the actuator 130 is electrically powered by current passed to the actuator via the rail power source 12 through the transfer assembly electrical interface 180. For example, in some embodiments, the actuator 130 may only be activated when the subject lift transfer assembly electrical interface 180 is engaged with and electrically coupled to the rail power source 12 to electrically couple the actuator 130 to the rail power source 12. In this way, in some embodiments, the actuator 130 may only be engaged at discrete locations of the rail 10 that include a rail power source 12. By limiting actuation of the actuator 130 to discrete locations of the rail 10, inadvertent actuation of the actuator 130 and subsequent movement of the subject lift 200 with respect to the subject lift transfer assembly 100 may be reduced.

Figure 4:
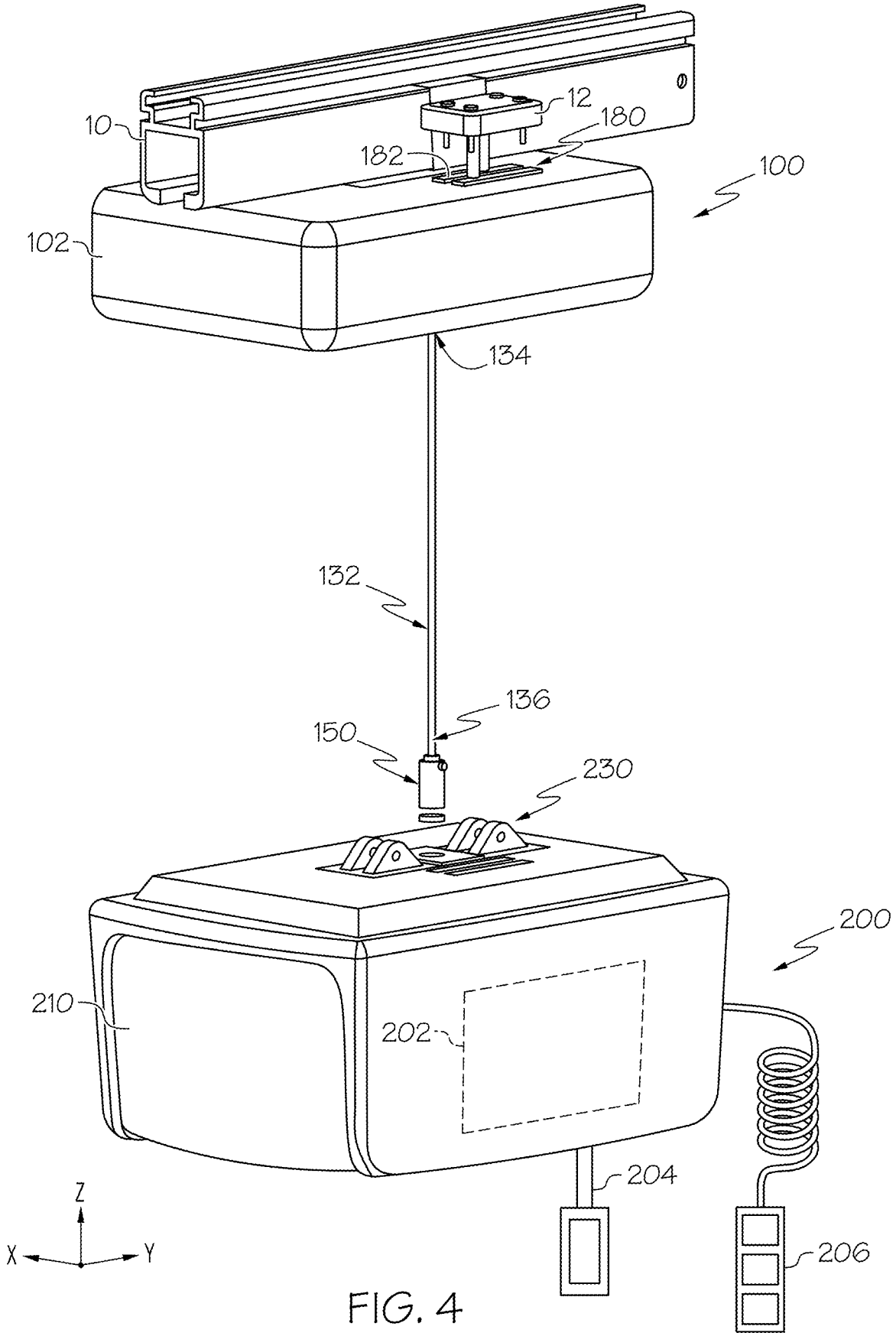
FIG. 4 schematically depicts a perspective view of the subject lift of FIG. 1 uncoupled from the subject lift transfer assembly, according to one or more embodiments shown and described herein.

Referring to FIG. 4, a perspective view of the subject lift 200 uncoupled from the subject lift transfer assembly 100 is schematically depicted. In embodiments, the subject lift transfer assembly 100 includes a cable 132 coupled to the actuator 130 (FIG. 3), the cable 132 extending between and terminating at an actuator end 134 that is engaged with the actuator 130 (FIG. 3) and a subject lift end 136 positioned opposite the actuator end 134. The cable 132, in embodiments, is selectively drawn to the trolley member 110 (FIG. 3) or paid out from the trolley member 110 in the vertical direction upon actuation of the actuator 130. For example, in some embodiments, the actuator 130 (FIG. 3) may include a motor or the like that rotates a drum. The cable 132 may be wound around the drum, such that rotation of the drum (e.g., as a result of actuation of the actuator 130 (FIG. 3)) causes the cable 132 to be drawn up to or paid out from the trolley member 110 (FIG. 3). In other embodiments, the actuator 130 (FIG. 3) may include any suitable construction to draw the cable 132 up to, or pay the cable 132 out from the trolley member 110 (FIG. 3) in the vertical direction, and may be powered in any suitable manner. In embodiments, the cable 132 may include any suitable construction to support the weight of the subject lift 200, for example and without limitation, woven fibers, twisted fibers, or the like, and may be formed from any suitable material, for example and without limitation, polymers, metals, composites, or the like.

In embodiments, the subject lift transfer assembly 100 further includes a subject lift connecting member 150 coupled to the subject lift end 136 of the cable 132. In some embodiments, the subject lift connecting member 150 is fixedly coupled to the subject lift end 136 of the cable 132 such that the subject lift connecting member 150 is not generally movable with respect to the cable 132, and the position of the subject lift connecting member 150 with respect to the cable 132 is generally constant.

Figure 5:
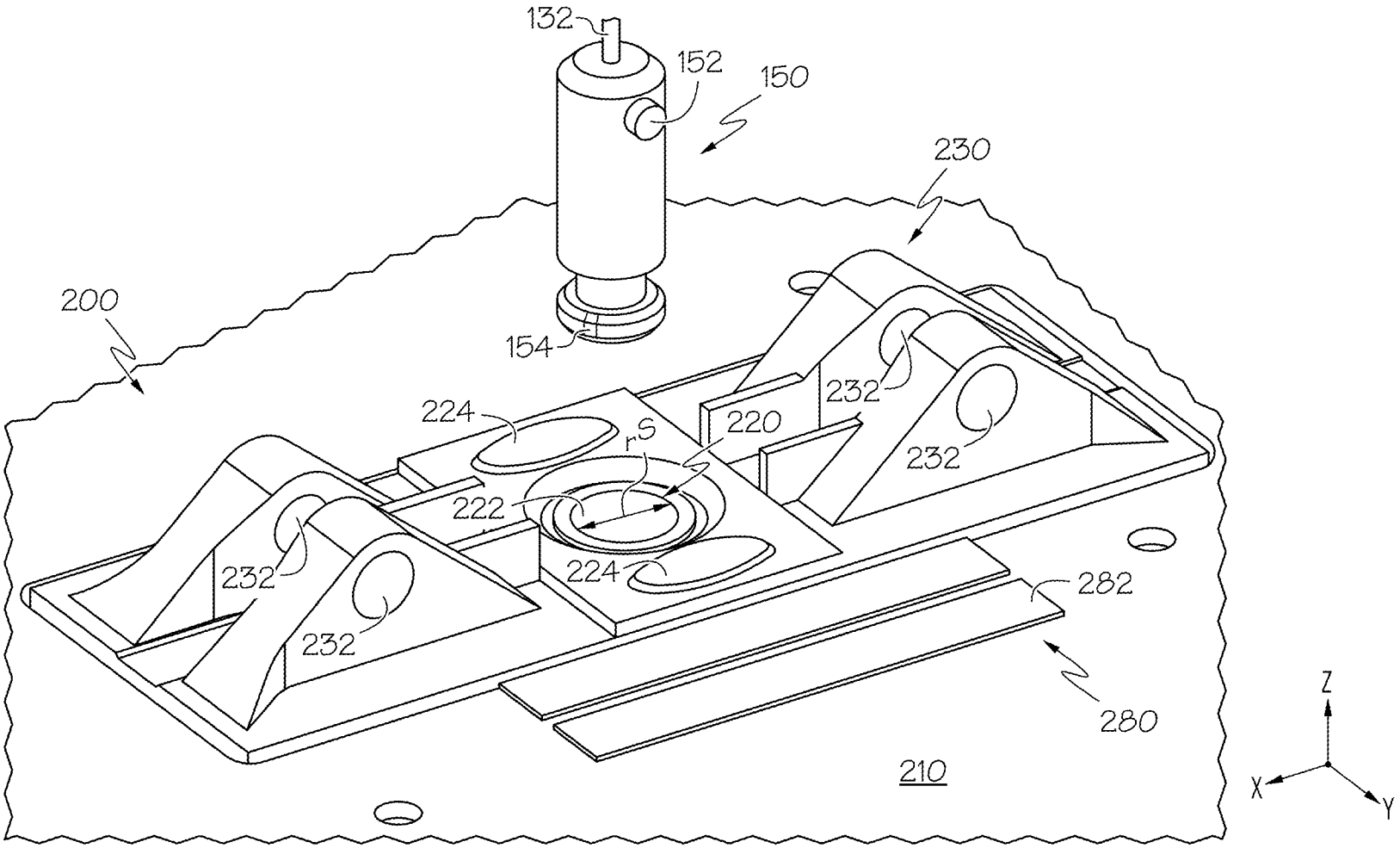
FIG. 5 schematically depicts a perspective view of a subject lift connecting member of the subject lift transfer assembly of FIG. 1 approaching the subject lift, according to one or more embodiments shown and described herein.

Referring to FIG. 5, an enlarged perspective view of the subject lift connecting member 150 approaching the subject lift 200 is schematically depicted. In embodiments, the subject lift 200 includes a trolley coupling member 230, which in the embodiment depicted in FIG. 5 is positioned on the housing 210 of the subject lift 200. The trolley coupling member 230 defines at least one aperture 232 extending through the trolley coupling member 230, and in the embodiment depicted in FIG. 5, the trolley coupling member 230 includes four apertures 232, with pairs of apertures 232 aligned with one another in the lateral direction. A pin may be passed through each of the pairs of apertures 232 to selectively couple the subject lift 200 to the subject lift transfer assembly 100 (FIG. 4), as described in greater detail herein.

The subject lift 200 further includes a cable coupling member 220 that is engageable with and may be selectively coupled to the subject lift connecting member 150. In the embodiment depicted in FIG. 5, the cable coupling member 220 is positioned on the housing 210 of the subject lift 200 and generally includes a receptacle 222 that receives the subject lift connecting member 150. The cable coupling member 220 may further include one or more releases 224 that selectively restrict a receptacle span rS defined by the receptacle 222. The receptacle span rS may be selectively restricted to engage and retain the subject lift connecting member 150 within the receptacle 222 once the subject lift connecting member 150 is inserted within the receptacle 222. Depression of the one or more releases 224 may expand the receptacle span rS such that the subject lift connecting member 150 is selectively removable from the receptacle 222. In this way, the subject lift connecting member 150 may act as a "quick-connect" that may selectively couple the subject lift 200 to the cable 132. While in the embodiment depicted in FIG. 5, the subject lift connecting member 150 includes a generally cylindrical shape and the receptacle 222 defines a circular shape, it should be understood that in other embodiments, the subject lift connecting member 150 and the receptacle 222 may include any suitable complementary shapes that cooperate to selectively couple the subject lift connecting member 150 to the cable coupling member 220.

In embodiments, the subject lift connecting member 150 includes an alignment member 152 that is positioned on a perimeter of the subject lift connecting member 150. In embodiments, the alignment member 152 assists in aligning the subject lift connecting member 150, and accordingly the subject lift 200, with trolley member 110 (FIG. 2), as described in greater detail herein.

In some embodiments, the subject lift connecting member 150 further includes a lift alignment feature 154 that is engageable with a complementary feature of the cable coupling member 220. For example, the lift alignment feature 154 may restrict rotation of the subject lift connecting member 150 about the Z-direction as depicted, when the subject lift connecting member 150 is inserted within the receptacle 222. In some embodiments, the lift alignment feature 154 includes a recess extending inward from the perimeter of the subject lift connecting member 150, and the lift alignment feature 154 may cooperate with a feature extending inward from the inner perimeter of the receptacle 222 to restrict rotation of the subject lift connecting member 150 about the Z-direction. In other embodiments, the lift alignment feature 154 may include a feature extending outward from the perimeter of the subject lift connecting member 150 that cooperates with a recess extending outward from the inner perimeter of the receptacle 222 to restrict rotation of the lift alignment feature 154.

In embodiments, the lift alignment feature 154 may also restrict insertion of the subject lift connecting member 150 into the receptacle 222 in certain orientations. For example, the lift alignment feature 154 may permit insertion of the subject lift connecting member 150 into the receptacle 222 with the lift alignment feature 154 oriented to face forward in the longitudinal direction (i.e., in the +X-direction), while the lift alignment feature 154 may restrict insertion of the subject lift connecting member 150 into the receptacle 222 when the lift alignment feature 154 is not oriented to face forward in the longitudinal direction. In this way, the lift alignment feature 154 may ensure insertion of the subject lift connecting member 150 into the cable coupling member 220 in a predetermined rotational orientation evaluated about the Z-direction. By ensuring a predetermined rotational orientation, the lift alignment feature 154 may assist in positioning the alignment member 152 of the subject lift connecting member 150 in a predetermined rotational orientation with respect to the cable coupling member 220, and accordingly the housing 210 of the subject lift 200. For example, in the embodiment depicted in FIG. 5, the lift alignment feature 154 is oriented such that the alignment member 152 is oriented to face in the +Y-direction when the subject lift connecting member 150 is inserted within the cable coupling member 220. By ensuring that the alignment member 152 is oriented in a predetermined rotational orientation with respect to the cable coupling member 220, the lift alignment feature 154 may assist in aligning the subject lift 200 to the subject lift transfer assembly 100 (FIG. 4), as described in greater detail herein. While the lift alignment feature 154 is described herein as permitting insertion of the subject lift connecting member 150 into the cable coupling member 220 when the lift alignment feature 154 is oriented to face forward in the longitudinal direction (i.e., in the +X-direction) such that the alignment member 152 is oriented to face in the lateral direction, it should be understood that the lift alignment feature 154 and the cable coupling member 220 may cooperate such that insertion of the subject lift connecting member 150 is permitted at any selected rotational orientation to align the lift alignment feature 154 as desired.

Figure 6A:
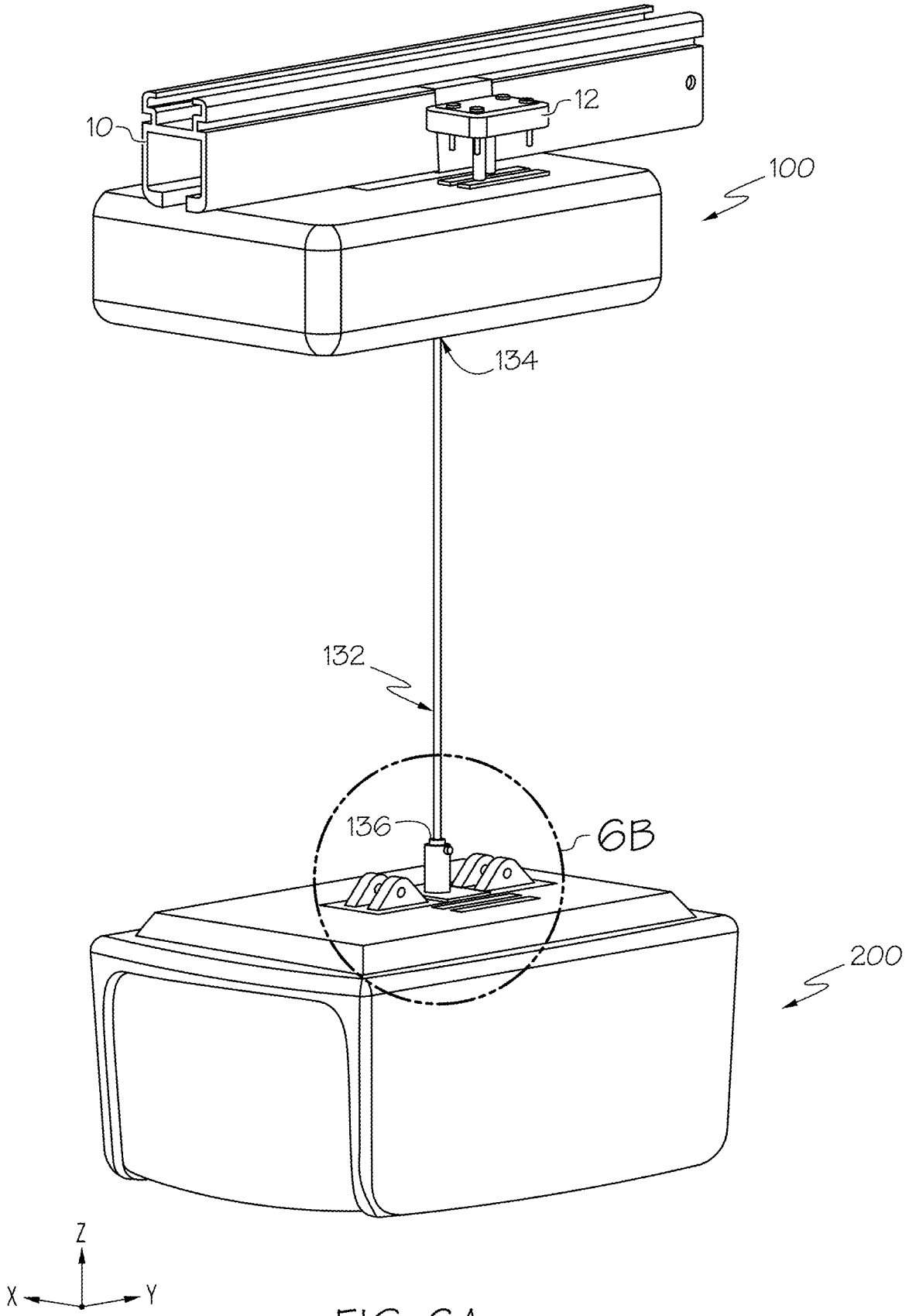
FIG. 6A schematically depicts a perspective view of the subject lift transfer assembly of FIG. 1 coupled to the subject lift through the subject lift connecting member, according to one or more embodiments shown and described herein.
Figure 6B:
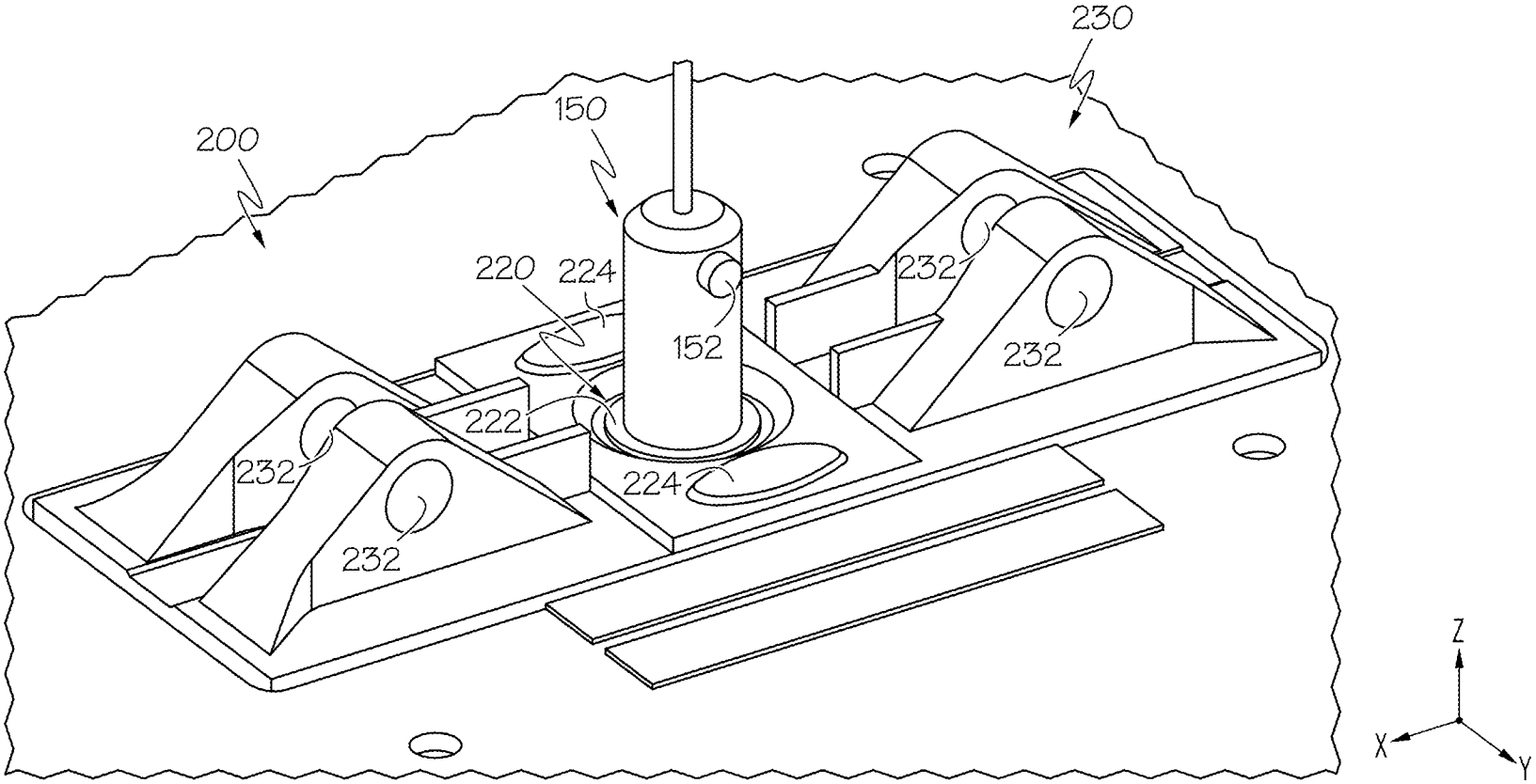
FIG. 6B schematically depicts an enlarged perspective view of the subject lift connecting member of FIG. 6B coupled to the subject lift, according to one or more embodiments shown and described herein.

Referring to FIGS. 6A and 6B, a perspective view and an enlarged perspective view of the subject lift connecting member 150 coupled to the subject lift 200 are schematically depicted, respectively. As noted above, the subject lift connecting member 150 may be inserted at least partially within the cable coupling member 220 (e.g., within the receptacle 222 (FIG. 5)) to selectively couple the subject lift connecting member 150 to the cable coupling member 220. Through the subject lift connecting member 150, the subject lift 200 is selectively coupled to the cable 132. With the subject lift 200 coupled to the cable 132, the subject lift 200 may be lifted upward in the vertical direction (i.e., in the +Z-direction) toward the subject lift transfer assembly 100. More particularly, the cable 132 may be drawn upward via actuation of the actuator 130 (FIG. 3) of the subject lift transfer assembly 100, and the subject lift 200 may be drawn upward toward the trolley member 110 (FIG. 3) of the subject lift transfer assembly 100.

Figure 7:
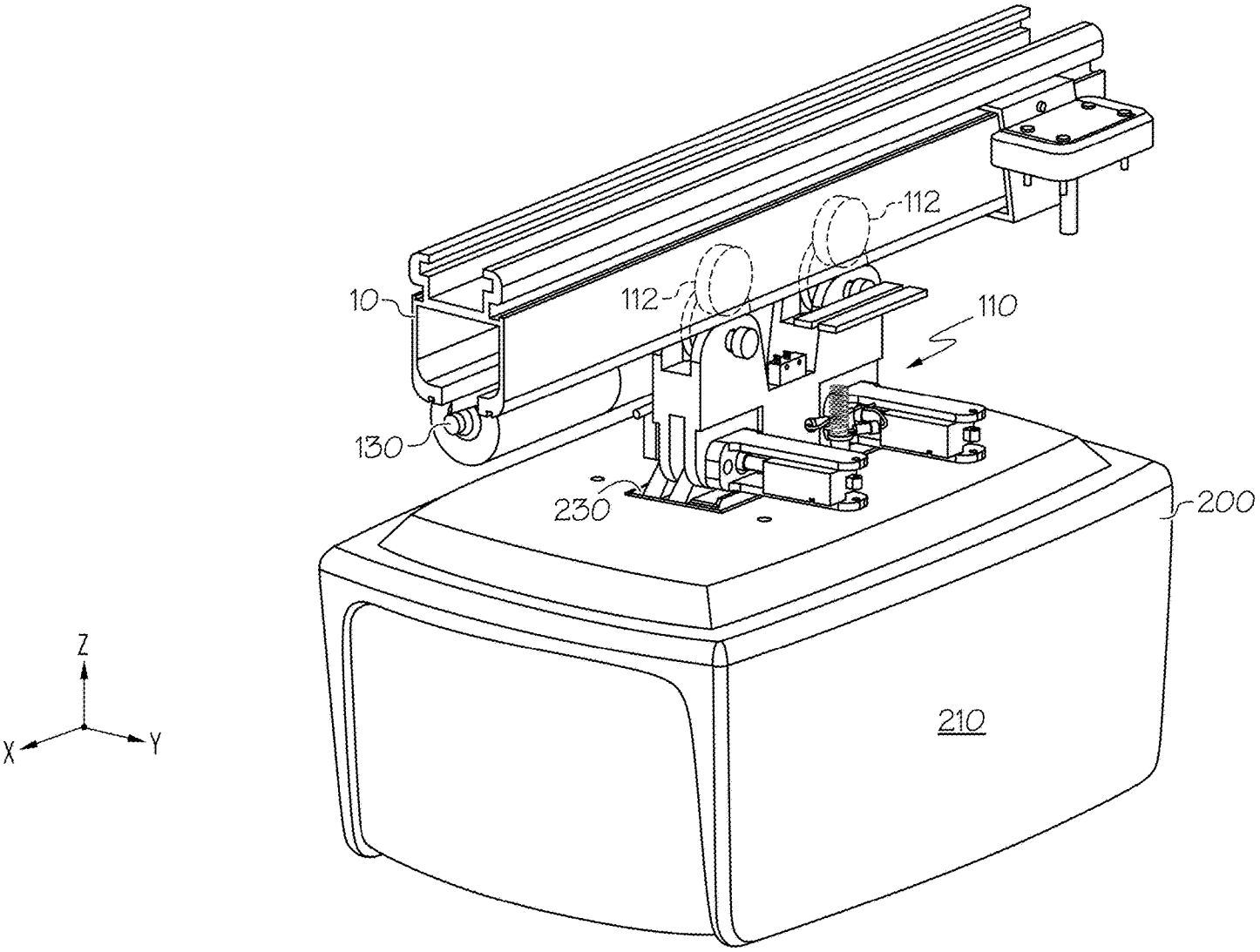
FIG. 7 schematically depicts a perspective view of the subject lift engaged with a trolley member of the subject lift transfer assembly of FIG. 1, according to one or more embodiments shown and described herein.
Figures 8A, 8B, 8C, 8D:
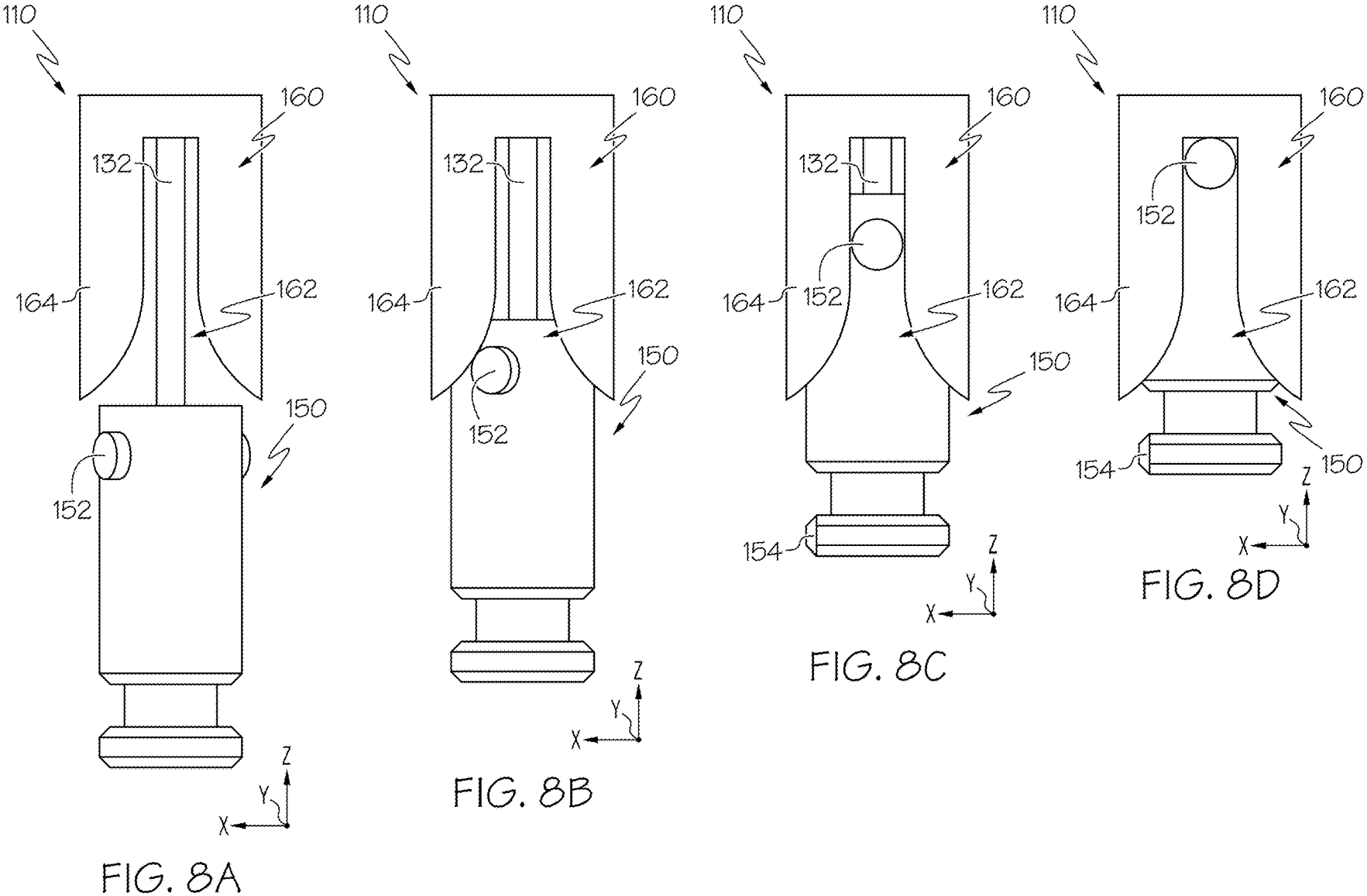
FIG. 8A schematically depicts an enlarged view of the subject lift connecting member of FIG. 5 approaching an alignment fixture of the subject lift transfer assembly of FIG. 1, according to one or more embodiments shown and described herein.
FIG. 8B schematically depicts an enlarged view of the subject lift connecting member of FIG. 5 initially engaging the alignment fixture of FIG. 8A, according to one or more embodiments shown and described herein.
FIG. 8C schematically depicts an enlarged view of the subject lift connecting member of FIG. 5 further engaging the alignment fixture of FIG. 8B, according to one or more embodiments shown and described herein.
FIG. 8D schematically depicts an enlarged view of the subject lift connecting member of FIG. 5 fully engaged with the alignment fixture of FIG. 8C, according to one or more embodiments shown and described herein.

Referring to FIGS. 7 and 8A, a perspective view of the subject lift transfer assembly 100 and an enlarged view of an alignment fixture 160 of the subject lift transfer assembly 100 are schematically depicted, respectively. The alignment fixture 160 may be coupled to the trolley member 110, and the cable 132 may pass through the alignment fixture 160, such that the subject lift connecting member 150 is drawn upward into the alignment fixture 160 as the cable 132 is drawn upward. The alignment fixture 160 defines a rotationally-discrete alignment feature 162 extending along the alignment fixture 160. In embodiments, the alignment fixture 160 defines a perimeter 164 including a shape complementary to the subject lift connecting member 150, and the rotationally-discrete alignment feature 162 is positioned on the perimeter 164. As referred to herein, the term "rotationally-discrete" means that the rotationally discrete alignment feature extends around a limited portion of the perimeter 164 of the alignment fixture 160 as the alignment fixture 160 is rotated about the Z-direction, as depicted.

In the embodiment depicted in FIG. 8A, the rotationally-discrete alignment feature 162 forms a gap extending through the perimeter 164 of the alignment fixture 160. The gap of the rotationally-discrete alignment feature 162 may be sized and shaped to receive the alignment member 152 of the subject lift connecting member 150. While the embodiment depicted in FIG. 8A includes a gap forming the rotationally-discrete alignment feature 162, it should be understood that in other embodiments, the rotationally-discrete alignment feature 162 may not extend through the perimeter 164 of the alignment fixture 160, but may include any suitable feature for engaging and aligning the alignment member 152 of the subject lift connecting member 150.

For example and referring to FIGS. 8A-8D, as the subject lift connecting member 150 is drawn upward (i.e., via upward movement of the cable 132), the subject lift connecting member 150 is drawn into the alignment fixture 160. As the subject lift connecting member 150 is drawn into the alignment fixture 160, the alignment member 152 is drawn into the rotationally-discrete alignment feature 162, which is sized and shaped to accept and align the alignment member 152 in a predetermined rotational orientation evaluated about the Z-direction as depicted. For example, in the embodiment depicted in FIGS. 8A-8D, the rotationally-discrete alignment feature 162 accepts and aligns the alignment member 152 to face outward in the lateral direction (i.e., in the +Y-direction as depicted). As described above, the subject lift connecting member 150 includes the lift alignment feature 154 that cooperates with the cable coupling member 220 (FIG. 5) to align the subject lift 200 (FIG. 5) in a predetermined rotational orientation with respect to the subject lift connecting member 150. Accordingly, through the engagement of the lift alignment feature 154 with the cable coupling member 220 (FIG. 5), and through engagement of the alignment member 152 with the rotationally-discrete alignment feature 162, the housing 210 (FIG. 7) of the subject lift 200 (FIG. 7) may be aligned with the subject lift transfer assembly 100 in a predetermined rotational orientation evaluated about the Z-direction as depicted. As described in greater detail herein, by aligning the housing 210 (FIG. 7) of the subject lift 200 (FIG. 7) in a predetermined rotational orientation, the trolley coupling member 230 (FIG. 2) of the subject lift 200 (FIG. 2) may be aligned with the trolley member 110 (FIG. 2).

Figure 9:
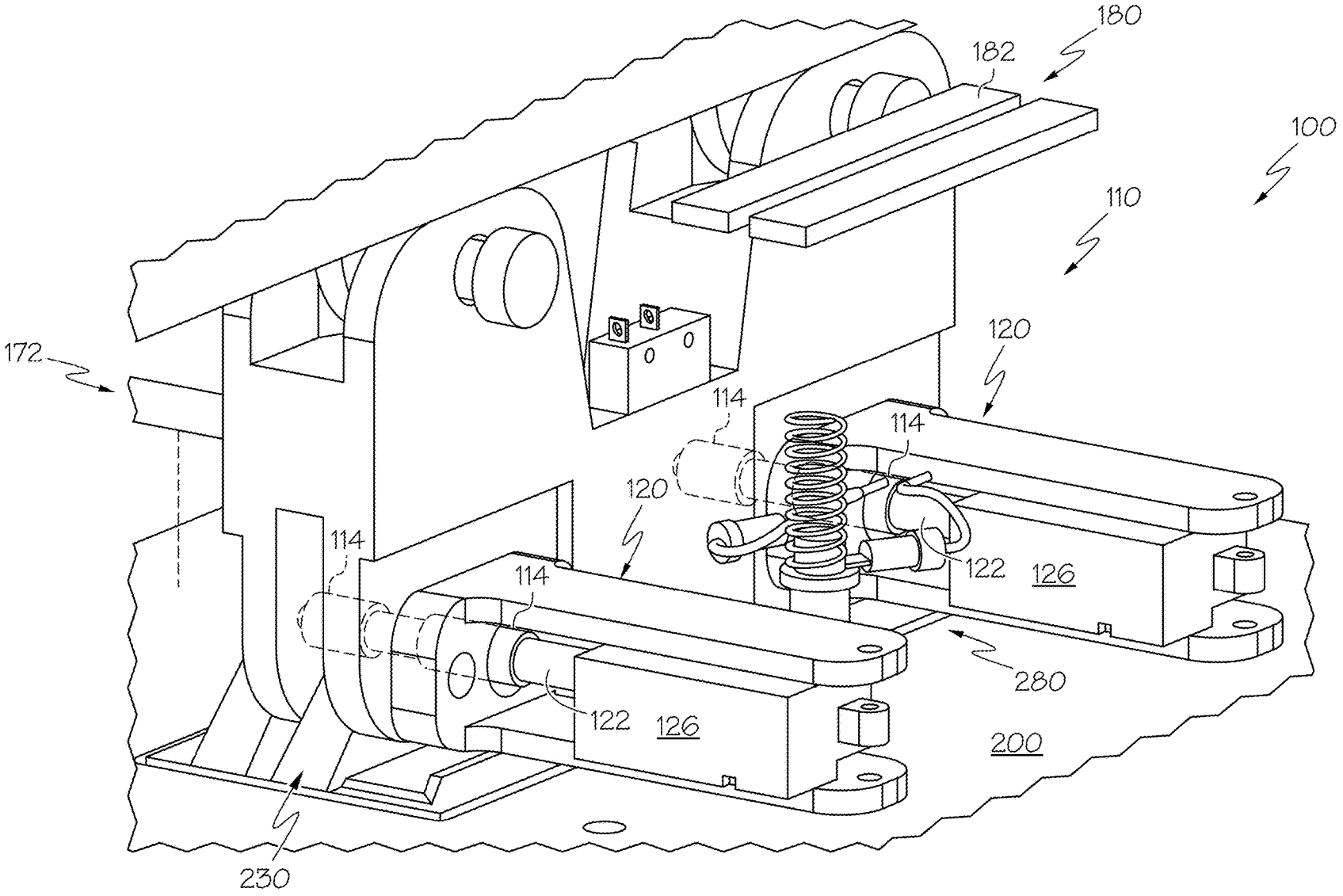
FIG. 9 schematically depicts a perspective view of the subject lift transfer assembly of FIG. 1 coupled to the subject lift, according to one or more embodiments shown and described herein.

Referring to FIG. 9, a perspective view of the subject lift 200 and the subject lift transfer assembly 100 with the housing 102 (FIG. 1) removed is schematically depicted. In embodiments, the trolley member 110 defines at least one aperture 114 extending through the trolley member 110 in the lateral direction. In the embodiment depicted in FIG. 9, the trolley member 110 defines four apertures 114, arranged as pairs or apertures 114 aligned in the lateral direction. As the subject lift 200 is lifted toward the trolley member 110, the subject lift 200 may be aligned such that the trolley coupling member 230 is aligned with the trolley member 110 and the subject lift 200 may be selectively coupled to the trolley member 110 via the apertures 114.

Figure 10B:
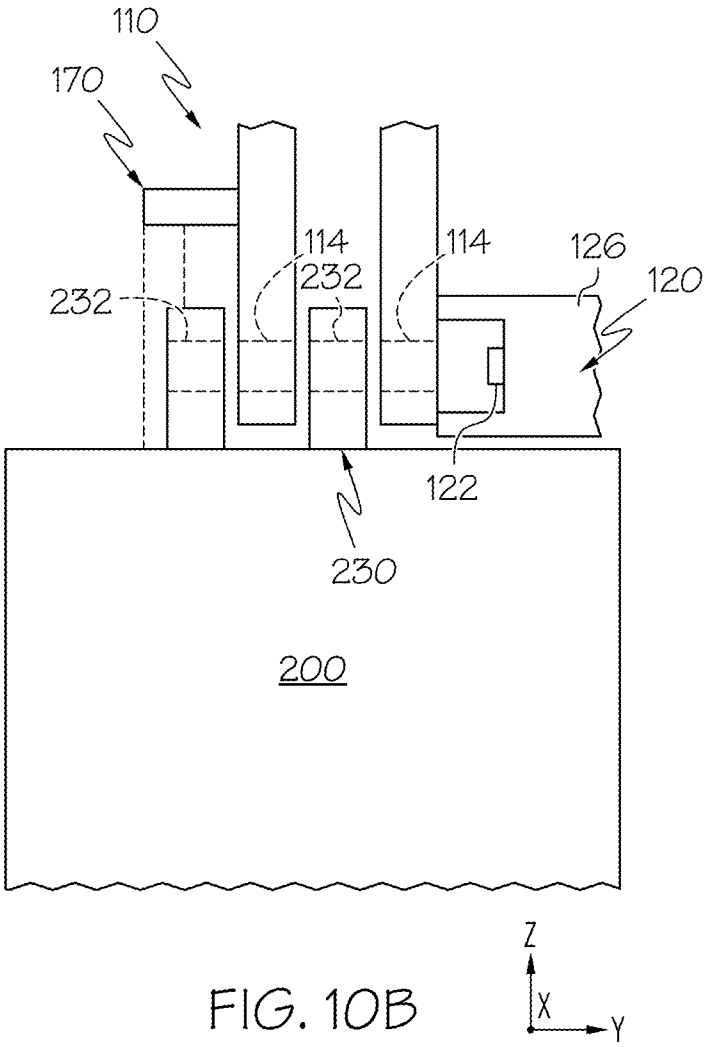
FIG. 10B schematically depicts a front view of the subject lift transfer assembly of FIG. 10A with the pin of the locking unit positioned in a disengaged position, according to one or more embodiments shown and described herein.
Figure 10A:
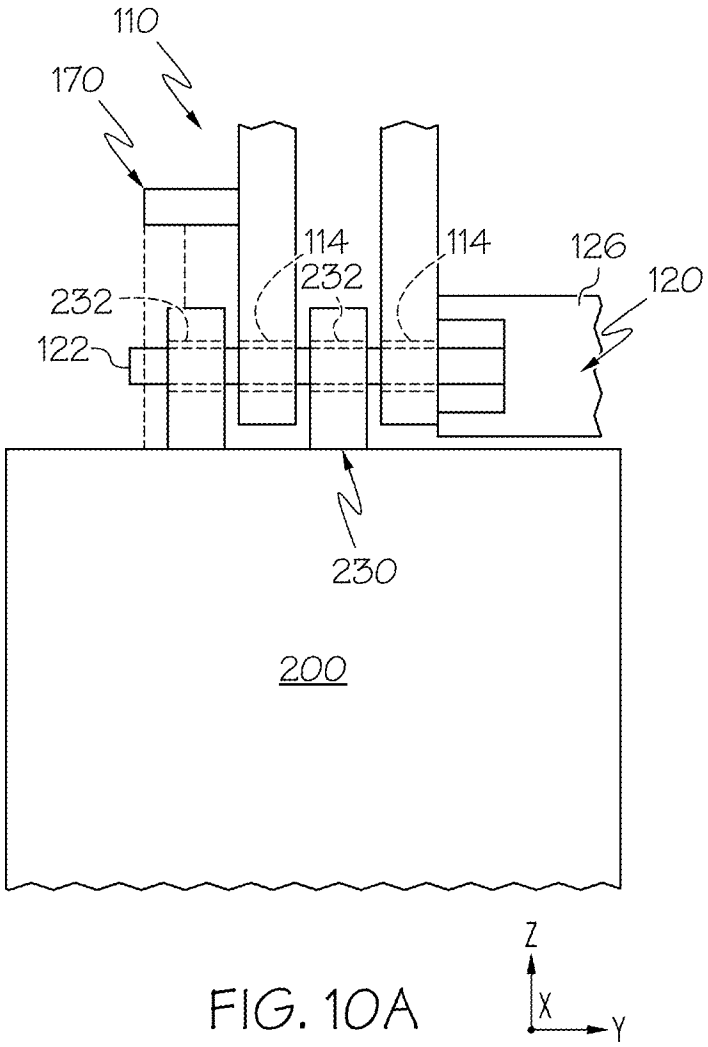
FIG. 10A schematically depicts a front view of the subject lift transfer assembly of FIG. 1 with a pin of a locking unit positioned in an engaged position, according to one or more embodiments shown and described herein.

More particularly and referring to FIG. 10A, a front view of the subject lift 200 engaged with the subject lift transfer assembly 100 is schematically depicted. As the subject lift 200 is lifted toward the subject lift transfer assembly 100, the trolley coupling member 230 is engaged with the trolley member 110, such that the apertures 232 of the trolley coupling member 230 are aligned the apertures 114 defined by the trolley member 110.

In embodiments, a locking unit 120 is coupled to the subject lift transfer assembly 100 or the subject lift 200 to selectively couple the subject lift 200 to the subject lift transfer assembly 100. The locking unit 120 generally includes at least one pin 122 that is selectively repositionable between an engaged position and a disengaged position to selectively couple the subject lift 200 to the subject lift transfer assembly 100. While reference is made herein to a single pin 122 and the front view of the locking unit 120 shows a single locking unit body 126, it should be understood that in some embodiments, the locking unit 120 includes a pair of locking unit bodies 126 and a pair of pins 122 associated with the locking unit bodies 126, as depicted in FIG. 9. In some embodiments, the locking unit 120 may include any suitable number of locking unit bodies 126 and associated pins 122. In each of the embodiments, the pins 122 and the locking unit bodies 126 may operate in substantially the same manner as the locking unit 120 depicted in FIGS. 10A and 10B and described below.

In the embodiment depicted in FIG. 10A, the pin 122 of the locking unit 120 is depicted in the engaged position, and the pin 122 extends through and outward from the apertures 114 of the trolley member 110. More specifically, the pin 122 extends through the apertures 114 of the trolley member 110 and through the through the apertures 232 of the trolley coupling member 230 in the engaged position to selectively couple the subject lift 200 to the subject lift transfer assembly 100. While in the embodiment depicted in FIG. 10A, the trolley coupling member 230 includes a pair of apertures 232 aligned with one another in the lateral direction, and the trolley member 110 includes a pair of apertures 114 aligned with one another in the lateral direction, it should be understood that in other embodiments, the trolley coupling member 230 and the trolley member 110 may include any suitable number of aligned apertures 232, 114 to selectively couple the subject lift 200 to the trolley member 110. For example, in some embodiments, the trolley member 110 may include a single aperture 114, and the pin 122 may extend through and outward from the aperture 114 of the trolley member 110 in the engaged position. Similarly, in some embodiments, the trolley coupling member 230 may include a single aperture 232, and the pin 122 may extend through the aperture 232 of the trolley coupling member 230 in the engaged position.

With the pin 122 extending through the apertures 114 of the trolley member 110 and through the apertures 232 of the trolley coupling member 230, the subject lift 200 is selectively coupled to the subject lift transfer assembly 100. More particularly, the pin 122 may restrict movement of the trolley coupling member 230 with respect to the trolley member 110 in the vertical direction, as the pin 122 is inserted through the apertures 114 of the trolley member 110 and the apertures 232 of the trolley coupling member 230.

The pin 122 is repositionable between the engaged position, as depicted in FIG. 10A, and a disengaged position, as shown in FIG. 10B. As shown in FIG. 10B, the pin 122 is retracted toward the locking unit body 126, such that the pin 122 extends further outward from the locking unit body 126 in the lateral direction in the engaged position (e.g., as depicted in FIG. 10A) than in the disengaged position.

In the disengaged position, the pin 122 is spaced apart from the apertures 232 of the trolley coupling member 230, such that the subject lift 200 is movable with respect to the subject lift transfer assembly 100 in the vertical direction when the pin 122 is in the disengaged position. As noted above, in some embodiments, the trolley coupling member 230 may include a single aperture 232, and in the disengaged position, the pin 122 is spaced apart from the aperture 232 in the disengaged position such that the subject lift 200 is movable with respect to the subject lift transfer assembly 100 in the vertical direction.

In embodiments, the locking unit 120 may include any suitable mechanism for moving the pin 122 between the engaged and the disengaged positions. In some embodiments, the locking unit 120 may include a solenoid and the pin 122 may be a plunger or may be coupled to a plunger that moves between the engaged position and the disengaged position upon the charging of the locking unit 120. In other embodiments, the locking unit 120 may include any suitable construction to move the pin 122 between the engaged position and the disengaged position, and may be electrically, pneumatically, or hydraulically powered. In some embodiments, the locking unit 120 is electrically coupled to the subject lift electrical interface 280 (FIG. 0.9) and/or the subject lift transfer assembly electrical interface 180 (FIG. 9), and the locking unit 120 is only operable and/or may only be powered when the subject lift transfer assembly electrical interface 180 is engaged with and electrically coupled to the rail power source 12 (FIG. 1). In this way, the pin 122 or pins 122 may only be moved between the engaged position and the disengaged position at discrete positions on the rail 10 (FIG. 1), e.g., only at locations including the rail power source 12. By limiting locations at which the locking unit 120 may move the pin 122 or pins 122 between the engaged position and the disengaged position, inadvertent repositioning of the pin 122 or pins 122 and inadvertent decoupling of the subject lift 200 from the subject lift transfer assembly 100 may be reduced.

Referring again to FIG. 9, in some embodiments, the subject lift transfer assembly 100 further includes a height sensor 172 that detects a distance evaluated between the height sensor 172 and the subject lift 200 in the vertical direction. The height sensor 172 may include any suitable sensor for detecting a distance between the height sensor 172 and the subject lift 200, for example and without limitation a LIDAR sensor, a proximity sensor, a laser sensor, a limit switch or the like. In embodiments, the subject lift 200 may be spaced apart from the height sensor 172 by a predetermined distance in the vertical direction when the trolley coupling member 230 is engaged with the trolley member 110. A detection from the height sensor 172 that the subject lift 200 is further apart from the height sensor 172 than the predetermined distance may indicate that the trolley coupling member 230 is not engaged with the trolley member 110 and the apertures 232 (FIG. 10A) of the trolley coupling member 230 are not aligned with the apertures 114 of the trolley member 110. In some embodiments, the height sensor 172 is communicatively coupled to the locking unit 120, and the locking unit 120 moves the pin 122 or pins 122 from the disengaged position into the engaged position (e.g., through the apertures 114 of the trolley member 110 and the apertures 232 of the trolley coupling member 230) in response to receiving a signal from the height sensor 172 that the subject lift 200 is positioned within the predetermined distance of the height sensor 172 in the vertical direction. Conversely, the locking unit 120 may retain the pin 122 or pins 122 in the disengaged position in response to receiving a signal from the height sensor 172 that the subject lift 200 is not positioned within the predetermined distance of the height sensor 172 in the vertical direction. In this way, the height sensor 172 may assist in confirming that trolley coupling member 230 is engaged with the trolley member 110 before inserting the pins 122 through the apertures 114 of the trolley member 110 and the apertures 232 of the trolley coupling member 230.

Referring collectively to FIGS. 10A and 10B, in some embodiments, the subject lift transfer assembly 100 includes an engagement sensor 170 coupled to the trolley member 110. The engagement sensor 170 may detect a position of the pin 122 or pins 122 with respect to the apertures 114 of the trolley member 110 and/or with respect to the apertures 232 of the trolley coupling member 230. For example the engagement sensor 170 may include a laser sensor, a light detection and ranging sensor (LIDAR), a proximity sensor, a limit switch, or the like, that detects the position of the pin 122 with respect to the apertures 114 of the trolley member 110 and/or with respect to the apertures 232 of the trolley coupling member 230. In general, the engagement sensor 170 may detect that the pin 122 is inserted through the apertures 114 of the trolley member 110 and/or the apertures 232 of the trolley coupling member 230. By detecting that the pin 122 is inserted through the apertures 114 of the trolley member 110 and/or the apertures 232 of the trolley coupling member 230, the engagement sensor 170 may assist in confirming that the subject lift 200 is coupled to the subject lift transfer assembly 100 by the pin 122 or pins 122. In some embodiments, movement of the subject lift transfer assembly 100 within the rail 10 may be restricted in response to the engagement sensor 170 detecting that the pin 122 is not inserted through the aperture 114 of the trolley member 110 and the aperture 232 of the trolley coupling member 230. For example, the subject lift transfer assembly 100 may include a brake or the like that restricts rotation of the at least one roller 112 (FIG. 7) within the rail 10 (FIG. 7) if the engagement sensor 170 does not detect that the pin 122 is inserted through the aperture 114 of the trolley member 110 and the aperture 232 of the trolley coupling member 230. In some embodiments, the subject lift transfer assembly 100 may include an audible and/or a visual alarm if the engagement sensor 170 does not detect that the pin 122 is inserted through the aperture 114 of the trolley member 110 and the aperture 232 of the trolley coupling member 230 after the locking unit 120 moves the pin 122 or pins 122 into the engaged position.

Figure 11:
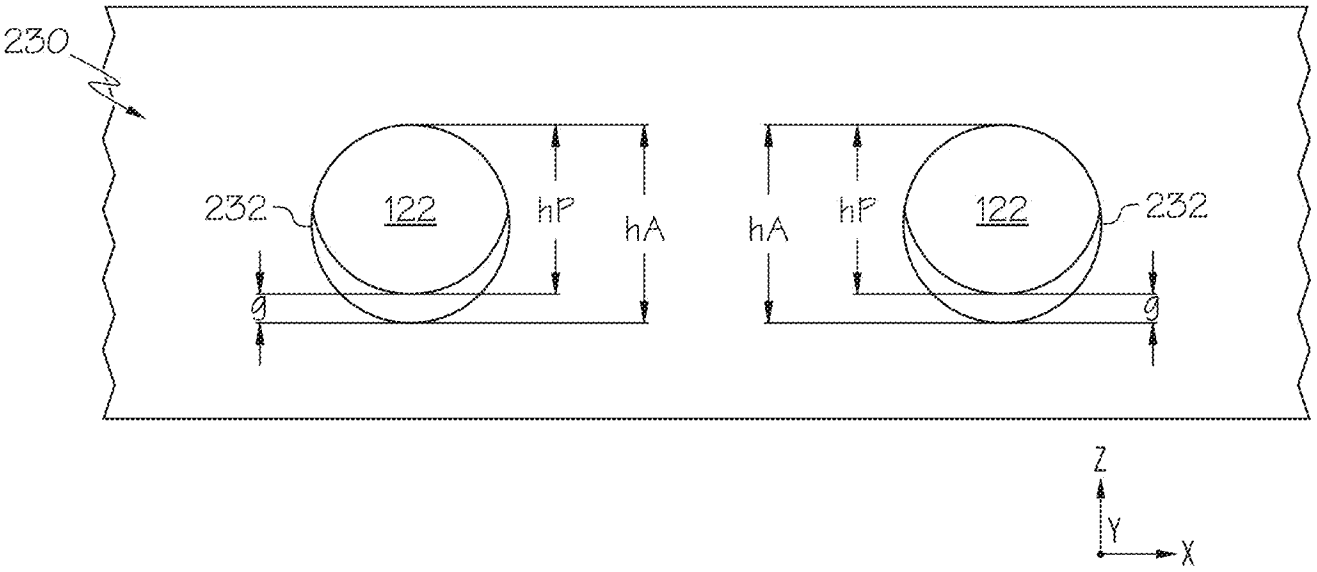
FIG. 11 schematically depicts a side view of the pin of the subject lift transfer assembly of FIG. 1 positioned within an aperture of the subject lift, according to one or more embodiments shown and described herein.

Referring to FIG. 11, a side view of the pins 122 of the locking unit 120 (FIG. 9) are depicted. In embodiments, each of the pins 122 define a span hP extending across each of the pins 122, and the apertures 232 define a span hA extending across each of the apertures 232. In the embodiment depicted in FIG. 11, the pins 122 and the apertures 232 each include generally cylindrical shapes, and the span hP of the pins 122 and the span hA of the apertures 232 are each diameters of the pins 122 and the apertures 232, respectively. In other embodiments, the pins 122 and/or the apertures 232 may include other shapes, for example and without limitation, rectangular shapes, oval shapes, or the like, and the span hP of the pins 122 and the span hA of the apertures 232 may each generally define a height of the pins 122 and the apertures 232 evaluated in the vertical direction. In embodiments, the span hP of the pins 122 is less than the span hA of the apertures 232. Because the pins 122 each include a span hP that is less than the span hA of the apertures 232, the pins 122 and the apertures 232 may define a gap g when the pins 122 are inserted into the apertures 232. More particularly, when the subject lift 200 (FIG. 9) is selectively coupled to the subject lift transfer assembly 100 (FIG. 9) by the pins 122, each of the pins 122 may form a gap g positioned below the pins 122 extending between the pins 122 and the apertures 232. Because the pins 122 include the span hP that is less than the span hA of the apertures 232, the apertures 232 and the pins 122 may avoid overconstraint when the pins 122 are inserted within the apertures 232.

Accordingly, it should now be understood that embodiments described herein are directed to subject lift transfer assemblies that selectively couple a subject lift to a rail. Subject lifts may be used to move subjects between various locations, however, subject lifts may be heavy and difficult to install to overhead rails. Subject lift transfer assemblies according to the present disclosure generally include a trolley member and at least one roller rotatably coupled to the trolley member. The at least one roller is engageable with an overhead rail to movably couple the subject lift transfer assembly to the rail. The subject lift transfer assembly may include an actuator and a cable coupled to the actuator, and a subject lift connecting member coupled to the cable. The subject lift connecting member may be selectively coupled to a subject lift, such that the actuator may lift the subject lift towards the subject lift transfer assembly with the cable. The actuator and the cable may draw the subject lift toward the trolley member so that apertures of the trolley member are aligned with apertures of the subject lift. In embodiments, a pin is passed through the apertures of the trolley member and the subject lift to selectively couple the subject lift to the subject lift transfer assembly. With the subject lift coupled to the subject lift transfer assembly, the subject lift, coupled to the rail through the subject lift transfer assembly, may be used to transport a subject between locations via the rail. To remove the subject lift from the subject lift transfer assembly, the pin may be removed from the apertures of the subject lift and the trolley member, and the subject lift may be lowered from the trolley member by the actuator.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A lift system comprising:

a trolley member defining an aperture extending through the trolley member;

a locking unit coupled to the trolley member, the locking unit comprising a locking unit body and a pin that extends outward from the locking unit body, wherein the pin is repositionable between an engaged position, in which the pin extends through the aperture of the trolley member, and a disengaged position, in which the pin is retracted toward to the locking unit body such that the pin extends further outward from the locking unit body in the engaged position than in the disengaged position;

an actuator coupled to the trolley member;

a cable extending between and terminating at an actuator end that is engaged with the actuator and a subject lift end positioned opposite the actuator end, wherein the cable is selectively drawn to the trolley member or paid out from the trolley member upon actuation of the actuator; and a subject lift connecting member coupled the subject lift end of the cable.

2. The lift system of claim 1, further comprising:

an alignment member positioned on the subject lift connecting member; and an alignment fixture coupled to the trolley member and defining a rotationally-discrete alignment feature, wherein the rotationally-discrete alignment feature restricts rotation of the subject lift connecting member when the alignment member is engaged with the rotationally-discrete alignment feature.

3. The lift system of claim 1, further comprising a subject lift selectively coupled to the trolley member, the subject lift comprising:

a housing;

a subject lift actuator positioned within the housing, wherein the subject lift actuator lifts a subject selectively coupled to the subject lift;

a cable coupling member positioned on the housing and selectively coupled to the subject lift connecting member; and a trolley coupling member positioned on the housing, the trolley coupling member defining an aperture extending through the trolley coupling member.

4. The lift system of claim 3, wherein the pin of the locking unit extends through the aperture of the trolley coupling member and the aperture of the trolley member in the engaged position, and the pin of the locking unit is spaced apart from the aperture of the trolley coupling member in the disengaged position.

5. The lift system of claim 3, further comprising a height sensor coupled to the trolley member, wherein the height sensor detects a position of the subject lift with respect to the height sensor and wherein the height sensor is communicatively coupled to the locking unit.

6. The lift system of claim 1, further comprising an engagement sensor coupled to the trolley member, wherein the engagement sensor detects a position of the pin with respect to the aperture of the trolley member.

7. The lift system of claim 1, further comprising a transfer assembly electrical interface coupled to the trolley member, wherein the transfer assembly electrical interface is electrically coupled to the actuator.

8. The lift system of claim 7, wherein the actuator is powered via current passing from the transfer assembly electrical interface to the actuator.

9. A lift system comprising:

a subject lift transfer assembly comprising:

a trolley member defining an aperture extending through the trolley member;

an actuator coupled to the trolley member;

a cable extending between and terminating at an actuator end that is engaged with the actuator and a subject lift end positioned opposite the actuator end, wherein the cable is selectively drawn to the trolley member or paid out from the trolley member upon actuation of the actuator; and a subject lift connecting member coupled the subject lift end of the cable;

a subject lift selectively coupled to the trolley member, the subject lift comprising:

a housing;

a subject lift actuator positioned within the housing, wherein the subject lift actuator lifts a subject selectively coupled to subject lift;

a cable coupling member positioned on the housing and selectively coupled to the subject lift connecting member; and a trolley coupling member positioned on the housing, the trolley coupling member defining an aperture extending through the trolley coupling member; and a locking unit coupled to the trolley member or the subject lift, the locking unit comprising a locking unit body and a pin that extends outward from the locking unit body, wherein the pin is repositionable between an engaged position, in which the pin extends through from the aperture of the trolley member and the aperture of the trolley coupling member, and a disengaged position, in which the pin is spaced apart from the aperture of the trolley coupling member.

10. The lift system of claim 9, further comprising:

an alignment member positioned on the subject lift connecting member; and an alignment fixture coupled to the trolley member and defining a rotationally-discrete alignment feature, wherein the rotationally-discrete alignment feature restricts rotation of the subject lift connecting member when the alignment member is engaged with the rotationally-discrete alignment feature.

11. The lift system of claim 9, further comprising a height sensor coupled to the trolley member, wherein the height sensor detects a position of the subject lift with respect to the height sensor and wherein the height sensor is communicatively coupled to the locking unit.

12. The lift system of claim 9, further comprising an engagement sensor coupled to the trolley member, wherein the engagement sensor detects a position of the pin with respect to the aperture.

13. The lift system of claim 9, further comprising a transfer assembly electrical interface coupled to the trolley member, wherein the transfer assembly electrical interface is electrically coupled to the actuator.

14. The lift system of claim 13, wherein the actuator is powered via current passing from the transfer assembly electrical interface to the actuator.

15. A method for coupling a subject lift to a rail, the method comprising:

coupling a subject lift connecting member to a subject lift;

lifting the subject lift toward a subject lift transfer assembly by drawing a cable coupled to the subject lift connecting member upward with an actuator of the subject lift transfer assembly;

aligning an aperture of a trolley coupling member of the subject lift with an aperture of a trolley member of the subject lift transfer assembly; and moving a pin through the aperture of the trolley member and the aperture of the trolley coupling member to couple the subject lift connecting member to the subject lift transfer assembly.

16. The method of claim 15, further comprising aligning the trolley coupling member of the subject lift with the subject lift transfer assembly by engaging an alignment member positioned on the subject lift connecting member with a rotationally-discrete alignment feature coupled to the trolley member, wherein the rotationally-discrete alignment feature restricts rotation of the subject lift connecting member.

17. The method of claim 15, further comprising detecting that the pin is inserted through the aperture of the trolley member and the aperture of the trolley coupling member.

18. The method of claim 17, further comprising restricting movement of the subject lift transfer assembly within the rail in response to detecting that the pin is not inserted through the aperture of the trolley member and the aperture of the trolley coupling member.

19. The method of claim 15, further comprising detecting a distance between a housing of the subject lift and the trolley member, and wherein moving the pin through the aperture of the trolley member is in response to detecting that the distance between the housing of the subject lift and the trolley member is within a predetermined distance.

20. The method of claim 15, further comprising electrically coupling the actuator to a rail power source coupled to the rail.

* * * * *